United States Patent [19]

Doveinis

[11] 4,174,865

[45] Nov. 20, 1979

[54] WINDOW REGULATOR MECHANISM

[75] Inventor: Juozas Doveinis, Sterling Heights, Mich.

[73] Assignee: General Motors Corporation, Detroit, Mich.

[21] Appl. No.: 921,729

[22] Filed: Jul. 3, 1978

[51] Int. Cl.[2] ..... E05F 5/10

[52] U.S. Cl. ..... 296/146; 49/103; 49/351

[58] Field of Search ..... 296/146; 49/103, 136, 49/144, 168, 227, 348, 349, 350, 351, 353, 374, 375

[56] References Cited

U.S. PATENT DOCUMENTS

| | | | |
|---|---|---|---|
| 3,859,753 | 1/1975 | Marcuzzi | 49/103 |
| 3,890,742 | 6/1975 | Ladd | 49/350 |

*Primary Examiner*—Philip Goodman
*Attorney, Agent, or Firm*—Ronald L. Phillips

[57] ABSTRACT

The drawings illustrate an automotive window regulator mechanism including a track having a substantially vertical track-section and a laterally extending section, a perforated plastic tape slidably mounted in the track, an actuator mechanism for driving the perforated tape along the track, a bracket arrangement secured to a window pane at the midpoint of the bottom edge thereof and connecting same to an end of the perforated tape for travel therewith up or down adjacent the vertical track-section. A counterbalance assembly is operatively connected between the laterally extending track section and the actuator mechanism for maintaining the tape taut to counterbalance the weight of the window pane.

2 Claims, 7 Drawing Figures

WINDOW REGULATOR MECHANISM

This invention relates generally to automotive window regulators and, more specifically, to a counterbalance assembly therefor.

While present day tape drive-type automotive window regulator mechanisms are generally satisfactory, there is a need for a simplified and economical window regulator mechanism which includes novel counterbalance means for maintaining the tape taut to efficiently counterbalance the weight of the window pane.

Accordingly, an object of the invention is to provide such an improved window regulator, including efficient counter-balance means.

Another object of the invention is to provide an automotive window regulator mechanism including a track having a substantially vertical track-section and a laterally extending section mounted on the inner door panel, a perforated plastic tape slidably mounted in the track, an actuator assembly for driving the perforated tape along the track, a connector device secured to a window pane at the midpoint of the bottom edge thereof and connecting same to an end of the perforated tape for travel therewith up or down adjacent the vertical track section, and improved counterbalance means mounted along the laterally extending track section and operatively connected to the perforated tape for maintaining the tape taut to counterbalance the weight of the window pane.

A further object of the invention is to provide a window regulator mechanism including an actuator assembly mounted within the side walls of a vehicular door in the forward half thereof, a bracket assembly secured to the bottom edge of a window pane at substantially the center point therealong, a continuous track in which a perforated tape is slidably mounted and adapted to being actuated by a sprocket of the actuator assembly, and a counterbalance mechanism to counterbalance the weight of the window pane. The bracket assembly operatively connects the window pane to the perforated tape such that any movements of the tape caused by operation of the actuator assembly actuates the window pane up or down in a path parallel to a vertically oriented portion of the track. The counterbalance mechanism includes a support member secured to the track at an intermediate point along a horizontally oriented portion of the track, a counterbalance arm pivotally mounted at one thereof in the support member and extending therefrom toward the vertically oriented track section, a roller rotatably mounted on the other end of the arm, the tape portion between the attached end of the tape and the toothed means of the actuator assembly being mounted around the roller, and a counterbalance spiral spring mounted in the support member and having one end thereof secured to the support member and the other end connected to the pivotal end of the arm for urging the arm away from the actuator assembly to maintain the tape taut and thereby counterbalance the weight of the window pane.

These and other objects and advantages of the invention will be apparent when reference is made to the following description and accompanying drawings, wherein.

Figure 2:
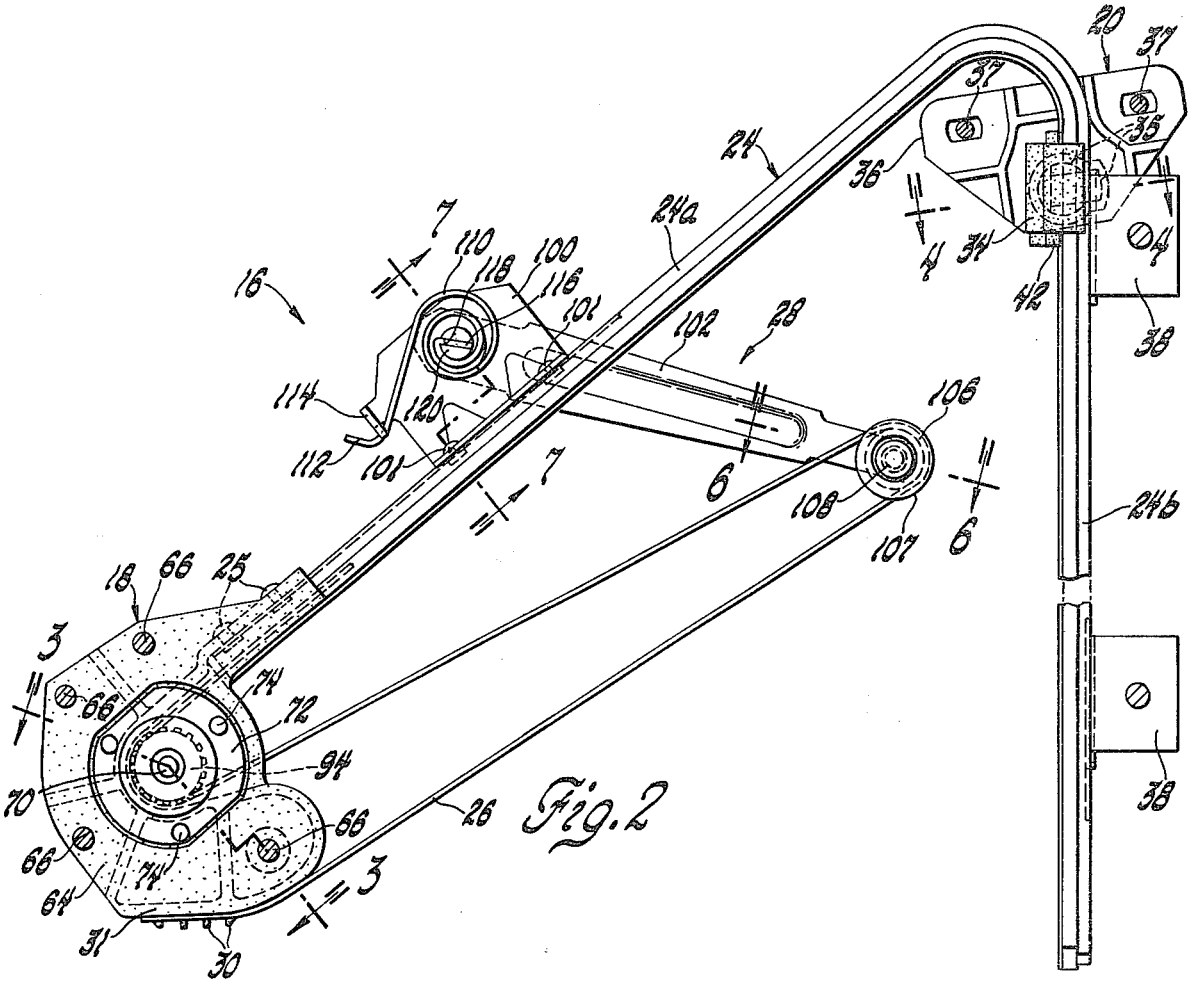
FIG. 2 is an enlarged view of the window regulator portion of FIG. 1.
Figure 3:
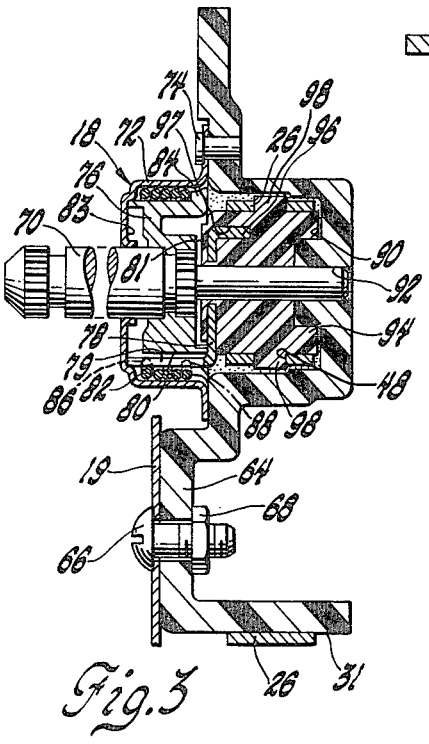
Figure 4:
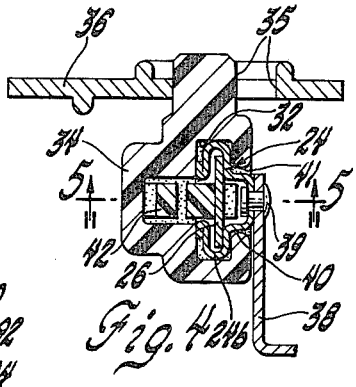
Figure 5:
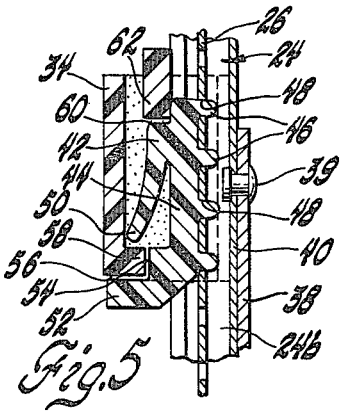
Figure 6:
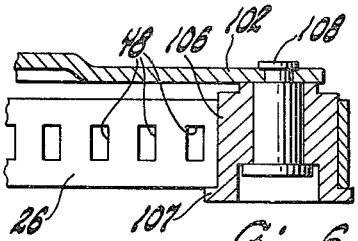
Figure 7:
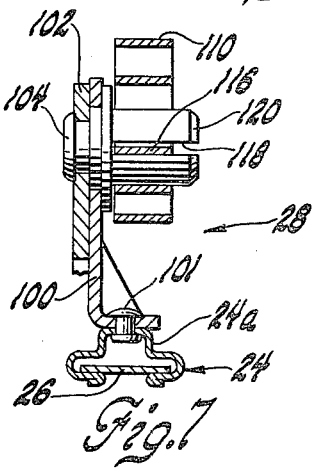

FIGS. 3, 4, 6 and 7 are enlarged cross-sectional views taken along the planes of lines 3—3, 4—4, 6—6, and 7—7, respectively, of FIG. 2, and looking in the direction of the arrows; and FIG. 5 is a cross-sectional view taken along the plane of line 5—5 of FIG. 4, and looking in the direction of the arrows.

Figure 1:
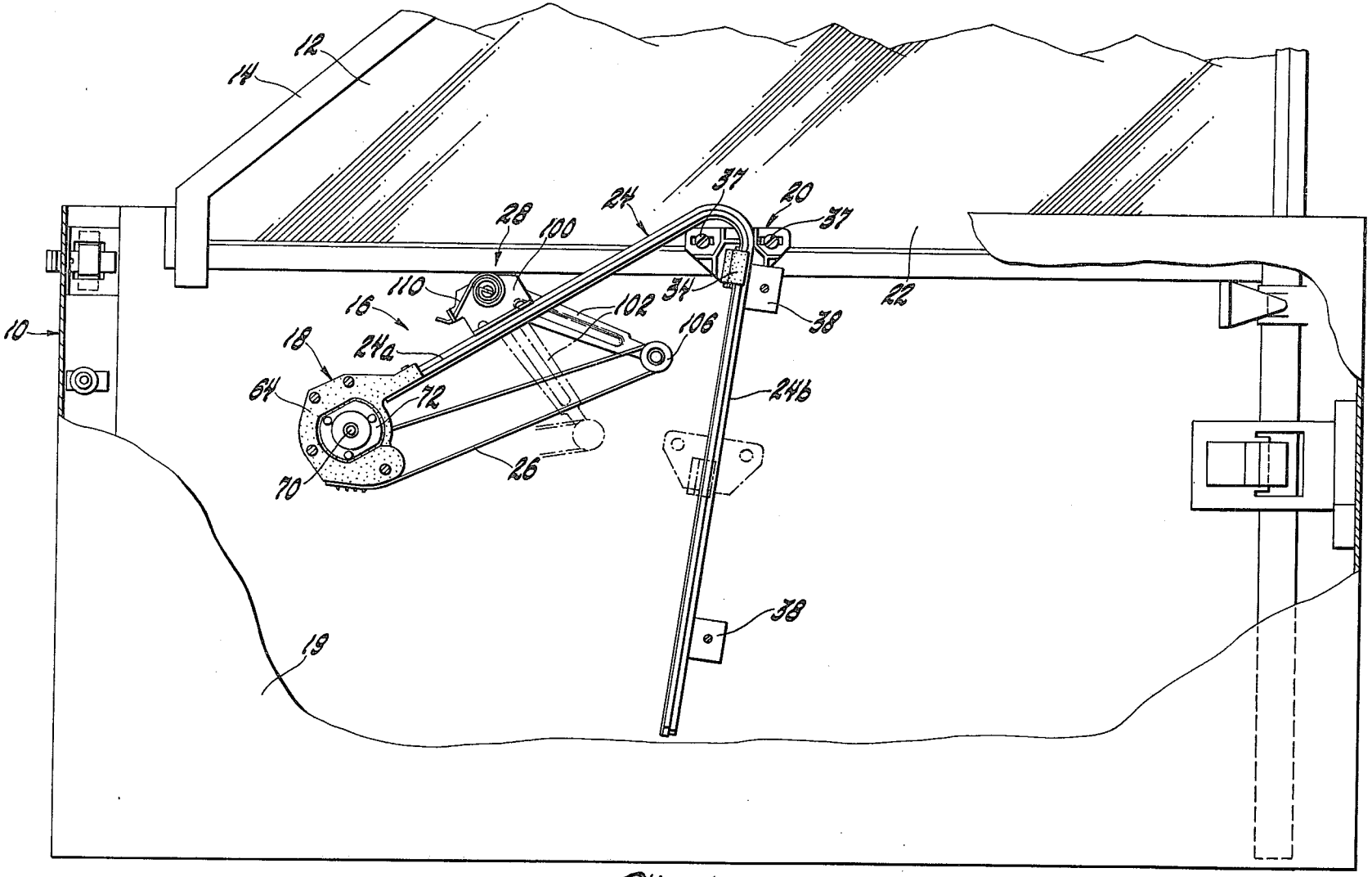
FIG. 1 is a side view of an automotive door having the inner wall panel partially removed to illustrate the inventive window regulator mechanism.

Referring now to the drawings in greater detail, FIG. 1 illustrates an automotive door 10 including a window pane 12 mounted in a frame 14. The window pane 12 is actuated upwardly and downwardly by a window regulator mechanism 16.

The window regulator mechanism 16 (FIG. 2) includes generally an actuator assembly 18 mounted on the inner panel 19 (FIG. 1) of the door 10, a bracket assembly 20 secured to the center of the bottom edge 22 (FIG. 1) of the window pane 12, a track 24 secured to the inner panel 19 for guiding a perforated tape 26 which is slidably mounted therein, and a counterbalance assembly 28 operatively connected to the tape 26 to maintain the latter taut and thereby counterbalance the weight of the window pane 12.

In FIGS. 1 and 2 it may be noted that the track 24 is formed of two sections in series, which will hereinafter be referred to as track sections **24*a* and 24*b*. Section 24*a* is secured at one thereof by rivets 25 to a flanged portion of the actuator assembly 18 and is mounted so as to extend rearwardly therefrom on a shallow upward slope. The secured end of the section 24*a* serves as an inlet section for one end of the tape 26 which is secured at its other end portion by suitable fastening means 30 to a flange 31 (FIG. 3) formed on an outer edge portion of the assembly 18**.

Section **24*b* operatively connects with the bracket assembly 20 by extending through an opening 32 (FIG. 4) formed in a guide block 34, the latter being operatively connected by a twist lock arrangement, represented at 35 in FIG. 4, to a lower sash bracket member 36. The latter member, in turn, is secured by screws 37 (FIG. 1) to the window pane 12**.

Section **24*b* is curved transversely in substantially the same arcuate shape as that of a conventional window pane 12, as shown in Podolan et al U.S. Pat. No. 4,004,371, to facilitate the travel of the bracket assembly 20 and, hence, of the window pane 12, from the upper closed position to the lower fully open position. The window pane 12 slides through a sealed opening in the top of the door 10. Mounting brackets 38 secure the upper and lower end portions of the track section 24*b* to the inner panel 19 of the door 10. Each bracket 38 is secured by a rivet 39 (FIG. 4) to a center ribbed portion 40 of the track section 24*b*, the guide block 34 having a longitudinal open ended slot 41 formed therein to accommodate the extension therethrough of the track ribbed portion 40**.

Referring now to FIGS. 4 and 5, it may be noted that the bracket assembly 20 further includes a hard plastic drive block 42. As shown in FIG. 5, the drive block 42 includes a longitudinal body portion 44 having four equally spaced teeth 46 formed on one side thereof extended through perforations 48 formed in the tape 26. A downwardly and outwardly extending spring arm 50 is integrally formed on the opposite side of the body portion 44, and a collar 52 and an adjacent abutment surface 54 for cooperation with the guide block 34 are formed on one end of the body portion. At assembly, the drive block 42 is slidably mounted into the guide block 34 from the lower end thereof, as seen in FIG. 5, depressing the spring arm 50, until the collar 52 abuts against the bottom face 56 of the guide block, at which time the spring arm 50 springs outwardly into position behind a rib 58 formed within the guide block, the collar 52 on one side and the spring arm 50 on the other side of the rib 58 thus serving to retain the drive block in place within the guide block. The end portion 60 of the spring arm 50 opposite the collar 52 end also abuts against a second rib 62 formed within the guide block 34.

The actuator or clutch assembly 18 is mounted within the door 10 by means of a mounting bracket 64. As better seen in FIG. 3, the bracket 64 is secured to the inner panel 19 by suitable bolts 66 and nuts 68. The assembly 18 includes a shaft 70 extended through the inner panel 19, the exposed end of which is knurled to accommodate the mounting thereon of a conventional window actuator handle [not shown]. The actuator assembly 18 further includes a cylindrical housing 72 (FIG. 3) secured to the bracket 64 by any suitable means, such as rivets 74. A hub or spring retainer 76 is secured to the shaft 70 within the housing 72. A drive plate 78 is mounted freely around the shaft 70 adjacent the inner face of the hub 76. An arcuate drive segment 79 is formed on an edge portion of the drive plate 78 and extends axially through an arcuate groove 80 formed in an outer peripheral surface portion of the hub 76. A thrust surface 81 may be formed between the drive plate 78 and the adjacent hub 76. A coil spring 82 is mounted around the outer peripheral surfaces of the hub 76 and the drive segment 79, and is retained circumferentially by the inner cylindrical surface of the housing 72 and axially between an end wall 83 of the housing 72 and a flange 84 formed on the inner end of the hub 76. Both ends 86 and 88 of the coil spring 82 are bent inwardly to straddle the edges of the axially extending drive segment 79 and provided a conventional wound-spring type drive means.

A pocket 90 is formed in the bracket 64 concentric with the shaft 70 and a central opening 92 is formed in the pocket 90 for rotatably receiving the inner end of the shaft 70. A gear 94 is mounted freely around the shaft 70 in the pocket 90 and secured for rotation with the drive plate 78 via a lug 96 formed on the latter and extended into a hole 97 formed in a face of the gear 94. Teeth 98 on the gear 94 mesh with the perforations 48 of the tape 26 which extends into and out of the pocket 90 through suitable openings [not shown] and half way around the gear 94, as shown in FIG. 2.

The counterbalance assembly 28 includes a counterbalance support member 100 secured by rivets 101 to the first track section **24*a* at an intermediate point therealong. A counterbalance arm 102 is pivotally mounted via a pivot pin 104 (FIG. 7) at one end thereof on the support member 100 and extends therefrom toward the second track section 24*b* when the window pane 12 is in a closed position (FIG. 1). A roller 106 including an end flange 107 is rotatably mounted via a pin member 108 (FIG. 6) on the other end of the arm 102. As shown in FIG. 2, the tape 26 extends from the fastening means 30 on the outer flanged surface 31 of the actuator assembly 18, to the roller 106 on which it is retained by the flange 107, and then enters the pocket 90 to mesh with the teeth 98 as indicated above, and exits therefrom into the first track section 24*a***.

A counterbalance spiral spring 110 is mounted on the support member 100, having one bent end 112 thereof secured to a retainer flange 114 (FIG. 2) formed on an edge portion of the support member and the other bent end 116 mounted in a slot 118 (FIG. 7) formed in a pin member 120 extending from the pin 104 for rotation with the arm 102. The spring 110 thus urges the arm 102 away from the actuator assembly 18 toward the track section **24*b*, maintaining the tape 26 taut at all times to thereby counterbalance the weight of the window pane 12** in all of its operative positions.

The operation of the window regulator mechanism 16 is assumed to be apparent from the above. However, briefly, in order to lower the window pane 12, manual rotation of the shaft 70 via a conventional handle [not shown] serves to rotate the hub 76, and, hence, one of the bent ends 86 and 88, thereby causing the spring 82 to wrap tightly around the drive segment 79 to drive the plate 78 and the associated gear 94. The external teeth 98 of the gear 94, in turn, rotate the tape 26. This drives the tape 26 along the track sections **24*a* and 24*b*, and the end of the tape 26 connected to the bracket assembly 20 moves downwardly (FIG. 1) in the track section 24*b*, causing the window pane 12** to move from its up or closed position to its down or open position.

As the window pane 12 is being lowered by the downwardly moving tape 26, the counterbalance arm 102 will be urged toward the actuator mechanism 18 by the moving tape as it rolls around the roller 106. Such movement of the arm 102 is indicated in phantom lines in FIG. 2, progressively winding the spring 110 around the slotted pin 120, thereby counterbalancing the weight of the progressively lowering window pane 12. The operation is reversed upon manual rotation of the shaft 70 in the opposite direction.

It is apparent that the invention provides a simplified efficient, and economical counterbalanced window regulator arrangement which could be adapted to a power window system as well.

While but one embodiment of the invention has been shown and described, other modifications thereof are possible.

The embodiments of the invention in which an exclusive property or privilege is claimed are defined as follows:

1. In a window regulator mechanism for use with an automotive door having spaced inner and outer panels, a window frame, and a window pane adapted to being slidably mounted in the window frame; an actuator assembly mounted in the door on the inner panel; a bracket assembly mounted on the window pane at a central location along the bottom edge thereof; a track including a first section operatively connected at one end thereof to the actuator assembly and extending therefrom to a point adjacent the bracket assembly when the window pane is in a closed position in the window frame, and a substantially vertically oriented second section integral with the first section and secured to a bottom portion of the inner panel, and a tape slidably mounted in the track and having one end thereof extending beyond the actuator end of the first track section, through the actuator assembly, and attached to an outer wall of the actuator assembly, the tape having equally-spaced perforations formed along the entire length thereof, the actuator assembly including a rotatable shaft and toothed means operatively connected to the shaft for meshing with the tape perforations for slidably reciprocally moving the tape along the first and second track sections, and the bracket assembly including connector means for connection with the other end of the tape for driving the bracket assembly and, hence, the window pane along a path parallel to the second track section intermediate the door panels in response to rotation of the shaft; the improvement comprising a counterbalance support member secured to the first track section at an intermediate point therealong; a counterbalance arm pivotally mounted at one end thereof in the support member and extending therefrom toward the second track section; a tape guide rotatably mounted on the other end of the arm and about which the tape is circumscribed and a counterbalance spring mounted in the support member for urging the arm away from the actuator assembly to maintain the tape taut and thereby counterbalance the weight of the window pane.

2. In a window regulator mechanism for use with an automotive door having spaced inner and outer panels, a window frame, and a window pane adapted to being slidably mounted in the window frame; an actuator assembly mounted in the door on the inner panel; a bracket assembly mounted on the window pane at a central location along the bottom edge thereof; a track including a first section operatively connected at one end thereof to the actuator assembly and extending therefrom to a point adjacent the bracket assembly when the window pane is in a closed position in the window frame, and a second section extending downwardly from the first section in a predetermined arcuate-shaped configuration and secured to a bottom portion of the inner panel, and a plastic tape slidably mounted in the track and having one end thereof extending beyond the actuator end of the first track section, through the actuator assembly, and attached to an outer wall of the actuator assembly, the plastic tape having equally-spaced perforations formed along the entire length thereof, the actuator assembly including a rotatable actuating shaft and toothed means operatively connected to the actuating shaft for meshing with the tape perforations for slidably reciprocally moving the plastic tape along the first and second track sections, and the bracket assembly including connector means for connection with the other end of the plastic tape for driving the bracket assembly and, hence, the window pane along a path parallel to the second track section intermediate the door panels in response to rotation of the actuating shaft; the improvement comprising a counterbalance support member secured to the first track section at an intermediate point therealong; a counterbalance arm pivotally mounted at one end thereof in the support member and extending therefrom toward the second track section; a roller rotatably mounted on the other end of the arm, the tape portion between the attached end of the tape and the toothed means of the actuator assembly being mounted around the roller; and a counterbalance spiral spring mounted in the support member and having one end thereof secured to the support member and the other end connected to the pivotal end of the arm for urging the arm away from the actuator assembly to maintain the tape taut and thereby counterbalance the weight of the window pane.

* * * * *